US005934635A

United States Patent [19]

Bohn

[11] Patent Number: 5,934,635

[45] Date of Patent: Aug. 10, 1999

[54] SELF-ADJUSTING ROCK CLIMBING ANCHOR DEVICE

[76] Inventor: David D. Bohn, 2900 Eindborough Dr., Fort Collins, Colo. 80525

[21] Appl. No.: 09/119,771

[22] Filed: Jul. 22, 1998

[51] Int. Cl.[6] ..... A47F 5/08

[52] U.S. Cl. ..... 248/231.9; 248/925

[58] Field of Search ..... 248/231.9, 925, 248/694

[56] References Cited

U.S. PATENT DOCUMENTS

| | | | |
|---|---|---|---|
| 3,877,679 | 4/1975 | Lowe | 248/694 |
| 3,903,785 | 9/1975 | Pepper, Jr. | 248/694 |
| 4,184,657 | 1/1980 | Jardine | 248/231.9 |
| 4,565,342 | 1/1986 | Grow | 248/231.9 |
| 4,572,464 | 2/1986 | Phillips | 248/231.9 |
| 4,575,032 | 3/1986 | Taylor | 248/231.9 |
| 4,586,686 | 5/1986 | Cason | 248/231.9 |
| 4,643,377 | 2/1987 | Christianson | 248/231.9 |
| 4,643,378 | 2/1987 | Guthrie et al. | 248/231.9 |
| 4,645,149 | 2/1987 | Lowe | 248/231.9 |
| 4,712,754 | 12/1987 | Brodie | 248/231.9 |
| 4,765,574 | 8/1988 | Thomas | 248/694 |
| 4,781,346 | 11/1988 | Banner | 248/231.9 |
| 4,832,289 | 5/1989 | Waggoner | 248/231.9 |
| 4,923,160 | 5/1990 | Waggoner | 248/200 |
| 5,484,132 | 1/1996 | George et al. | 248/231.9 |

*Primary Examiner*—Ramon O. Ramirez
*Assistant Examiner*—Stephen S. Wentsler
*Attorney, Agent, or Firm*—Flanagan & Flanagan; John K. Flanagan; John R. Flanagan

[57] ABSTRACT

A self-adjusting rock climbing anchor device includes at least one variable-length compression arm, at least one fixed-length load arm, a pivot element pivotally connecting the compression and load arms to one another, and at least one fixed-length follower cable. The follower cable interconnects the compression and load arms at intermediate locations thereon so as to form at least one four-bar linkage defined by the pivot element, the compression arm, the load arm and the follower cable, the follower cable. The movement of the compression and load arms between an unwedged and wedged condition provides for self-adjustment of the compression and load arms within the cleft and enables use of the compression and load arms in clefts of different sizes. The device further includes at least one spring which biases the compression arm toward a maximum length and thereby preloads the device to resist forces directed on the device from outside of a plane defined by the compression and load arms.

23 Claims, 4 Drawing Sheets

SELF-ADJUSTING ROCK CLIMBING ANCHOR DEVICE

BACKGROUND OF THE INVENTION

1. Field of the Invention

The present invention generally relates to anchors for rock climbing and, more particularly, is concerned with a self-adjusting rock climbing anchor device.

2. Description of the Prior Art

Rock climbing is a favorite pastime and challenge for many people. Climbers may ascend clefts in cliffs or other rock formations. Such maneuvers require climbers to have a means for self-arrest for preventing a fall if they lose their footing or grip. A variety of devices have been developed over the years providing climbers with self-arrest means.

Representative examples of these prior art devices are disclosed in U.S. Pat. No. 3,877,679 to Lowe, U.S. Pat. No. 3,903,785 to Pepper, Jr., U.S. Pat. No. 4,184,657 to Jardine, U.S. Pat. No. 4,565,342 to Grow, U.S. Pat. No. 4,572,464 to Phillips, U.S. Pat. No. 4,575,032 to Taylor, U.S. Pat. No. 4,586,686 to Cason, U.S. Pat. No. 4,643,377 to Christianson, U.S. Pat. No. 4,643,378 to Guthrie et al., U.S. Pat. No. 4,645,149 to Lowe, U.S. Pat. No. 4,712,754 to Brodie, U.S. Pat. No. 4,765,574 to Thomas, U.S. Pat. No. 4,781,346 to Banner, U.S. Pat. No. 4,832,289 to Waggoner, U.S. Pat. No. 4,923,160 to Waggoner and U.S. Pat. No. 5,484,132 to George et al. Many of these prior art devices include a spring-loaded camming means and components which function as wedges which become captured within the cleft above the climber who is secured to the self-arresting device by a rope attached thereto.

A problem exists, however, with many prior art devices when they are subjected to out-of-plane forces, such as forces created by rope drag. The prior art devices may become displaced or "walk out" of their initial placement when subjected to one or more of these forces.

Consequently, a need still exists for a device which provides a solution to the aforementioned problem in the prior art without introducing any new problems in place thereof.

SUMMARY OF THE INVENTION

The present invention provides a self-adjusting rock climbing anchor device which is designed to satisfy the aforementioned need. The rock climbing anchor device of the present invention is self-adjusting so as to return the device to a secure position between walls of a cleft upon displacement or "walk out" of the device from its initially secure placement when the device is subjected to one or more out-of-plane forces. The self-adjusting rock climbing anchor device is also biased to resist out-of-plane forces and thereby further reduces the problem of "walk out" found in prior art devices.

Accordingly, the present invention is directed to a self-adjusting rock climbing anchor device which comprises: (a) at least one variable-length compression arm; (b) at least one fixed-length load arm; (c) a pivot element pivotally interconnecting the compression and load arms to one another; and (d) at least one fixed-length follower cable. The follower cable interconnects the compression arm and load arm at intermediate locations thereon so as to form at least one four-bar linkage defined by the pivot arm, the compression arm, the load arm and the follower cable, the follower cable being located at least at a side of the pivot element. The compression and load arms are movable between unwedged and wedged conditions relative to a pair of spaced apart opposing walls of a cleft. In the unwedged condition, the compression and load arms are disposed in respective first positions relative to a horizontal reference defined by the pivot element of the device pivotally interconnecting the compression and load arms. In the wedged condition, the compression and load arms are disposed in respective second positions relative to the horizontal reference. The movement of the compression and load arms between the unwedged and wedged conditions in response to the application of a load force thereto provides for self-adjustment of the compression and load arms within the cleft and enables use of the compression and load arms in clefts of different sizes. Preferably, the compression and load arms in their respective first positions are angularly displaced from one another and disposed substantially below the horizontal reference. The compression arm in its second position is disposed substantially above the horizontal reference, while the load arm in its second position is angularly displaced from the compression arm and disposed substantially below the horizontal reference.

The device has, in a first embodiment, a pivot element and a set of a compression arm, load arm and follower cable being located at a first side of the pivot element, and in a second embodiment, the device additionally has a second set of a compression arm, load arm and follower cable being located at an opposite second side of the pivot element.

The compression arm includes an outer member and an inner member. The outer and inner members interfit telescopably with one another and are movable relative to one another such that the compression arm is moved between a maximum length and a minimum length. Each of the outer and inner members of the compression arm has opposite ends. The inner member has a longitudinal slot. The follower cable has opposite upper and lower ends. The upper end of the follower cable is mounted to one of the opposite ends of the outer member and disposed through the longitudinal slot of the inner member and movable with the outer member relative to the inner member of the compression arm.

The compression arm changes away from its maximum length toward its minimum length and back toward its maximum length as the compression and load arms are moved from the unwedged condition to the wedged condition. The compression and load arms also have an intermediate condition between the unwedged and wedged conditions in which the compression arm is substantially disposed along the horizontal reference and has a minimum length and the load arm is substantially disposed below the horizontal reference.

The device further comprises at least one spring. The spring biases the compression arm toward its maximum length. The bias of the spring preloads the device to resist forces directed on the device from outside of a plane defined by the compression and load arms of the device. One spring is used in the first embodiment. A pair of springs are used in the second embodiment.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
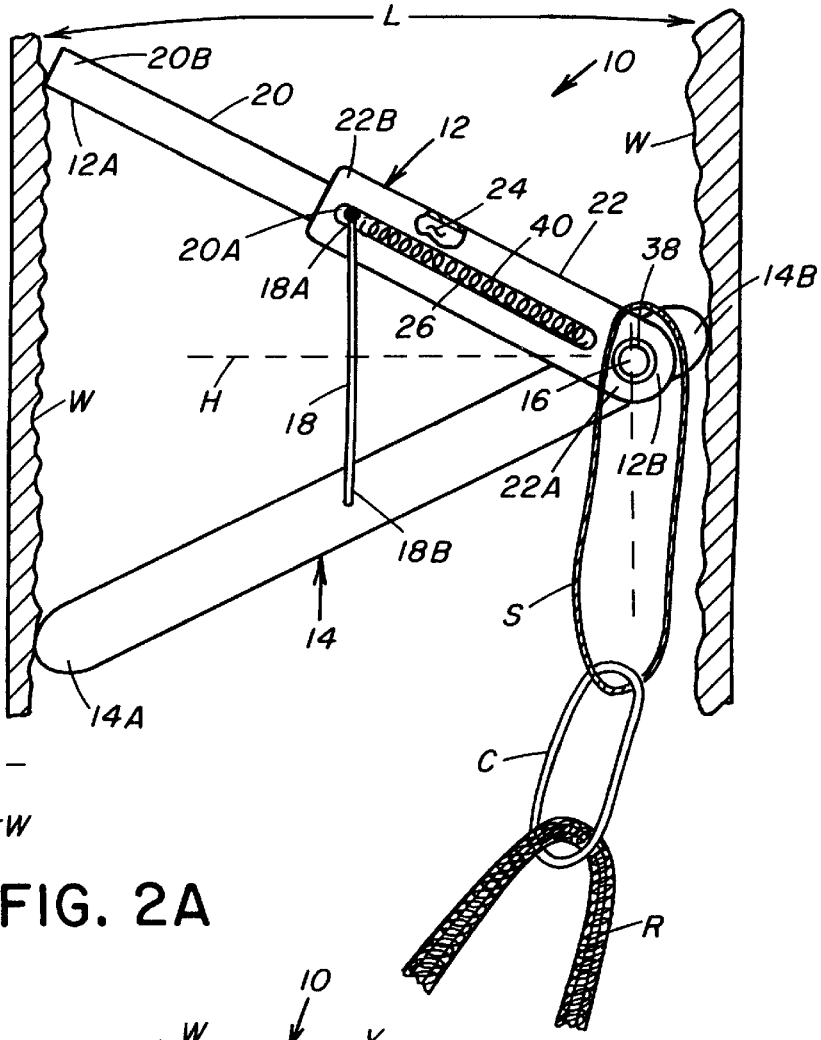
FIG. 1 is a side elevational view of a first embodiment of a self-adjusting rock climbing anchor device of the present invention having only one compression arm and one load arm and showing the positions of the compression and load arms with the device in a wedged condition.

Referring to the drawings and particularly to FIGS. 1 and 3 to 9, there is illustrated a self-adjusting rock climbing anchor device, generally designated 10, of the present invention. A first embodiment of the device 10 is shown in FIG. 1 whereas a second embodiment of the device 10 is shown in FIGS. 3 to 9.

With respect to both embodiments, the self-adjusting rock climbing anchor device 10 basically includes at least one variable-length compression arm 12, at least one fixed-length load arm 14, a pivot element 16 such as a pin pivotally interconnecting the compression and load arms 12, 14 to one another, and at least one fixed-length keeper or follower cable 18. The follower cable 18 interconnects the compression arm 12 and load arm 14 at respective intermediate locations thereon so as to form at least one four-bar linkage defined by the pivot element 16, the compression arm 12, the load arm 14 and the follower cable 18, the follower cable 18 being located at least at a side of the pivot element 16. The compression and load arms 12, 14 are movable relative to the pivot pin 16 between an unwedged unsecured condition and a wedged secured condition of the device 10 relative to a pair of spaced apart opposing walls W of a cleft L.

Figure 2A:
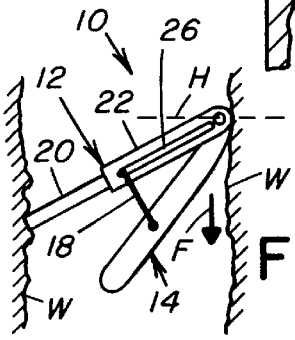
FIGS. 2A to 2E are diagrammatic representations of the first embodiment of the self-adjusting rock climbing anchor device of FIG. 1 shown at successive positions of the compression and load arms of the device in placing the device in a cleft.
Figure 2B:
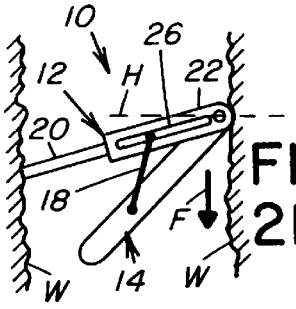
Figure 2D:
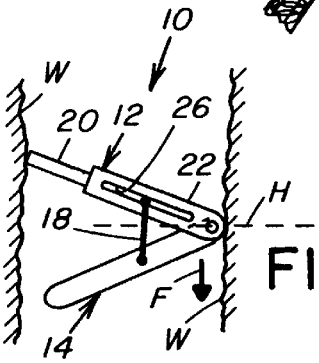
Figure 2C:
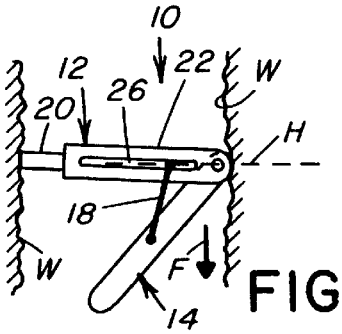
Figure 2E:
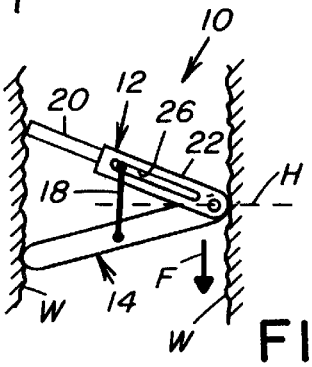
Figure 3:
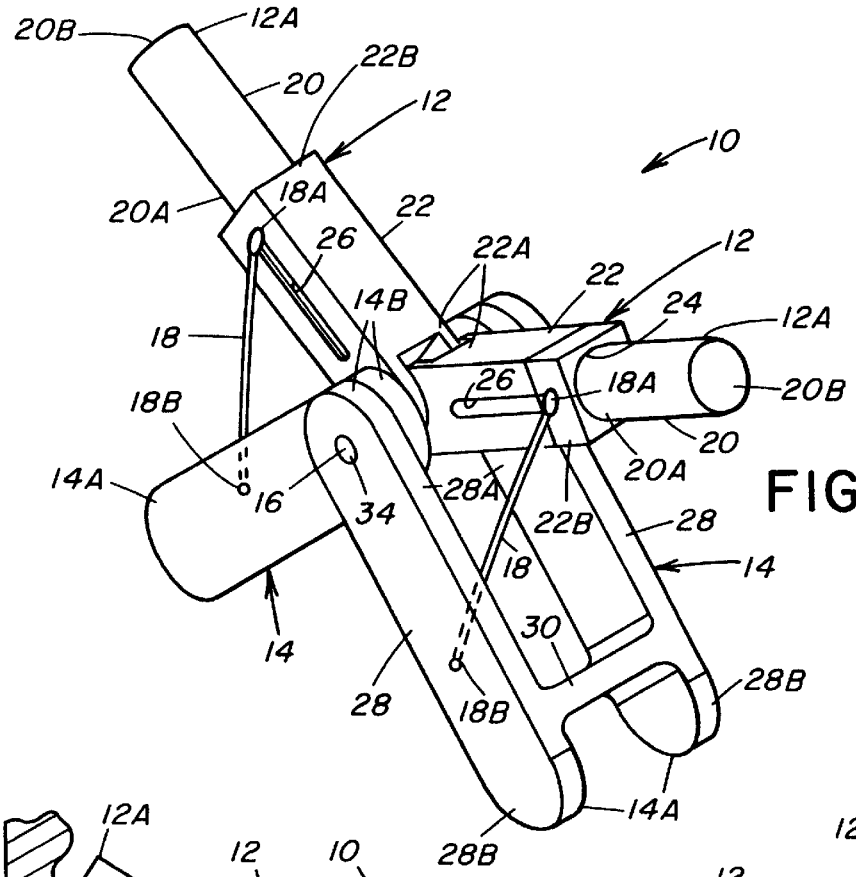
FIG. 3 is a perspective view of a second embodiment of the self-adjusting rock climbing anchor device having a pair of the compression arms and a pair of load arms.
Figure 10A:
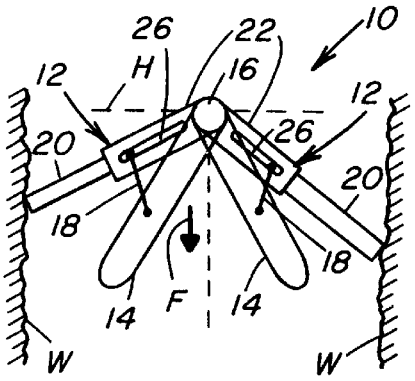
FIGS. 10A to 10E are diagrammatic representations of the second embodiment of the self-adjusting rock climbing anchor device of FIG. 4 shown at successive positions of the compression and load arms of the device in placing the device in a cleft.
Figure 10B:
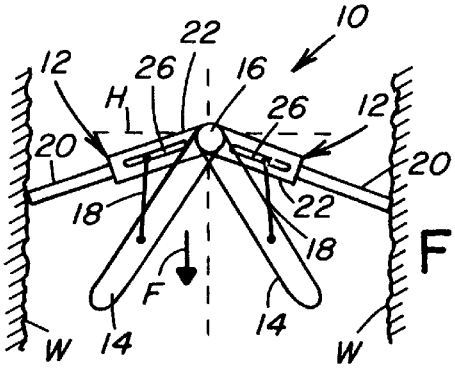
Figure 10C:
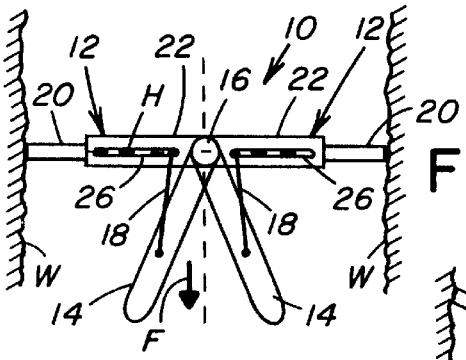
Figure 10D:
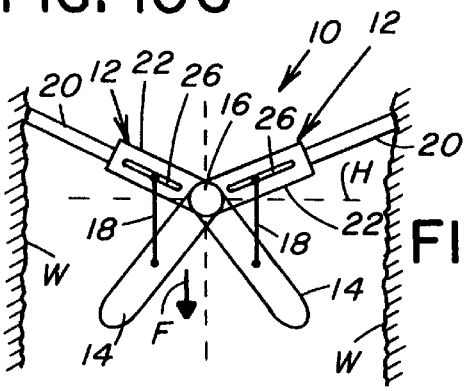
Figure 10E:
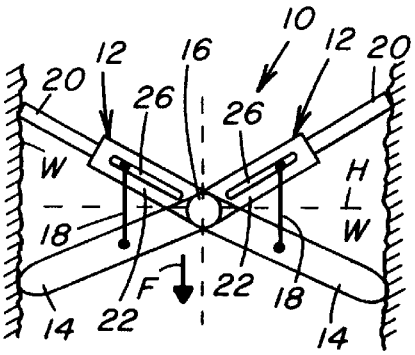

In the unwedged condition of the first embodiment shown in FIG. 2A and of the second embodiment shown in FIG. 10A, the compression and load arms 12, 14 of the device 10 are angularly displaced from one another and disposed in respective first positions relative to a horizontal reference H defined by pivot pin 16 of the device 10, whereas in the wedged condition of the first embodiment shown in FIG. 2E and of the second embodiment shown in FIG. 10E the compression and load arms 12, 14 are angularly displaced from one another and disposed in respective second positions relative to the horizontal reference H which are different from the first positions. The pivotal movement of the compression and load arms 12, 14 between the unwedged and wedged conditions of the device 10 in response to the application of a load force F thereto provides for self-adjustment of the compression and load arms 12, 14 within the cleft L and also enables use of the device 10 in clefts L of different sizes.

In a preferred pull-down mode or process of placing and securing the device 10 in the cleft L as successively illustrated in FIGS. 2 and 10, the application direction of the load force F is downward and the compression and load arms 12, 14 in their respective first positions in the unwedged condition of the device 10 shown in FIGS. 2A and 10A are disposed substantially below the horizontal reference H. The compression and load arms 12, 14 in their respective second positions in the wedged condition of the device 10 shown in FIGS. 2E and 20E are respectively disposed substantially above and below the horizontal reference H. In an alternative push-up mode or process of placing and securing the device 10 in the cleft L (not shown), the application direction of the load force would be upward and the compression and load arms 12, 14 in both their respective first and second positions would be respectively disposed substantially above and below the horizontal reference H.

Referring now to FIGS. 1 to 10, in the first embodiment shown in FIGS. 1 and 2 the device 10 has the pivot element 16 and a first set of a compression arm 12, load arm 14 and follower cable 18 being located at a first side of the pivot element 16, whereas in the second embodiment shown in FIGS. 3 to 6 and 10 the device 10 additionally has a second set of a compression arm 12, load arm 14 and follower cable 18 being located at an opposite second side of the pivot element 16. Each compression arm 12 in both embodiments of the device 10 has opposite outer and inner ends 12A, 12B and includes an outer member 20 and an inner member 22. The outer and inner members 20, 22 of each compression arm 12 interfit telescopably with one another and are movable relative to one another such that the compression arm 12 is moved between a maximum length, as seen in FIGS. 1, 2A, 2E, 3–6, 10A and 10E, and a minimum length, as seen in FIGS. 2C and 10C. Preferably, the outer member 20 telescopes into the inner member 22. The outer member 20 preferably has a substantially cylindrical configuration, though may have any other suitable shape. The inner member 22 has a substantially rectangular configuration, though may have any other suitable shape. The inner member 22 is tubular in shape and defines a central passageway 24. Also, the central passageway 24 has a substantially cylindrical configuration, though may have any other suitable shape. Each of the outer member 20 and the central passageway 24 of the inner member 22 has a diameter of any suitable size, though, preferably, the diameter of the outer member 20 is slightly smaller than the diameter of the central passageway 24 of the inner member 22 for receiving the outer member 20 therein. Each of the outer and inner members 20, 22 has, respectively, opposite inner and outer ends 20A, 20B and 22A, 22B. The outer end 20B of the outer member 20 is the same as the outer end 12A of the compression arm 12. The inner end 22A of the inner member 22 is the same as the inner end 12B of the compression arm 12. The inner end 20A of the outer member 20 is disposed within the outer end 22B of the inner member 22. The inner member 22 also has a longitudinal slot 26. The opposite ends of the slot 26 are spaced interiorly from the opposite inner and outer ends 22A, 22B of the inner member 22, but extends nearly the full length of the inner member 22.

Referring to FIGS. 3 and 5 to 7, each load arm 14 in both embodiments of the device 10 has opposite outer and inner ends 14A, 14B. Also, each load arm 14 includes a pair of opposite side members 28 spaced apart from and preferably disposed substantially parallel to one another and a connecting member 30 extending transversely, and preferably perpendicularly, between and interconnecting the side member 28 so as to provide the load arm 14 in a substantially U-shaped configuration, though may have any other suitable configuration. Each side member 28 has a pair of opposite inner and outer ends 28A, 28B. The outer end 28B of the side member 28 is for engaging the cleft L. The connecting member 30 is disposed closer to the outer end 28B than the inner end 28A of each of the side members 28 so as to provide the load arm 14 in the substantially U-shaped configuration. The inner end 22A of the inner member 22 of a respective compression arm 12 and inner end 14B of the load arm 14 are pivotally interconnected to one another by the pivot element 16. Each side member 28 is elongated and substantially flat and has rounded ends and the connecting member 30 is substantially flat, though each may have any other suitable configuration. For example, within the purview of the present invention, the upper surfaces of the load arm 14 can be cam shaped. The shape of the cam on the outer end 14A of the load arm 14 would be such that the angle between the force vector and the pivot element 16 would always be between the angles of 60 degrees and 80 degrees.

Figure 5:
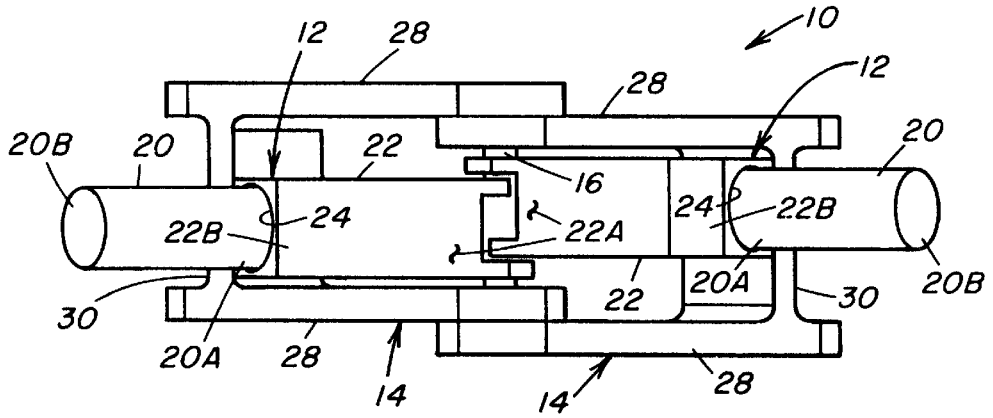
FIG. 5 is a top plan view of the device of FIG. 3.
Figure 7:
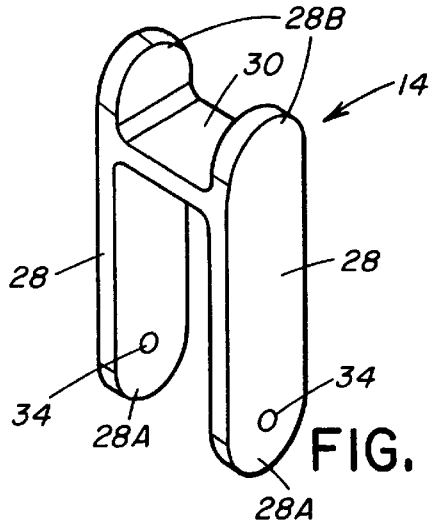
FIG. 7 is a perspective view of the load arm found in both the first and second embodiments of the device.
Figure 6:
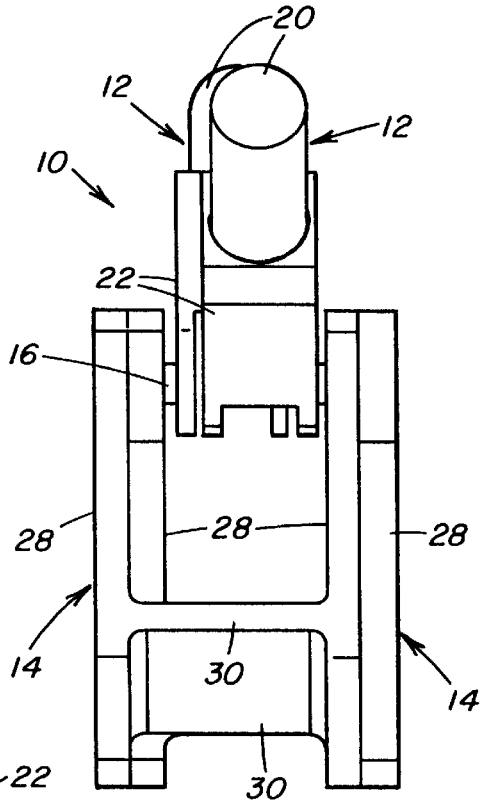
FIG. 6 is an end elevational view of the device as seen along line 6—6 of FIG. 5.
Figure 8:
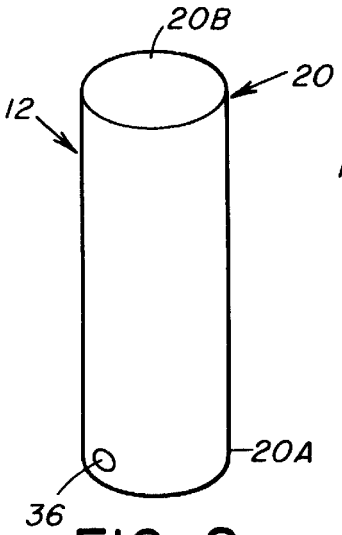
FIG. 8 is a perspective view of an outer member of the compression arm found in both the first and second embodiments of the device.
Figure 9:
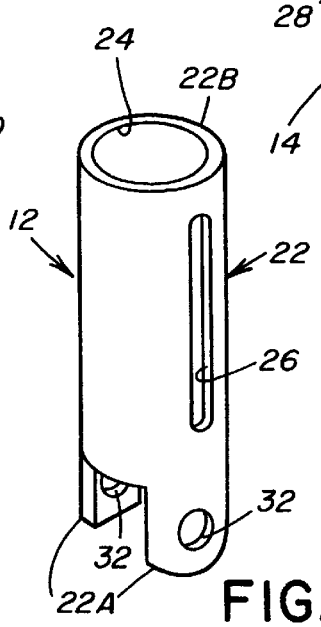
FIG. 9 is a perspective view of an inner member of the compression arm found in both the first and second embodiments of the device.

In FIG. 5, the compression arms 12 are shown opposing each other substantially in a common plane which is the plane containing the gravity vector. It should be understood that it is within the purview of the present invention to mount the compression arms 12 at a slight angle, for example 5 to 10 degrees, away from the perpendicular relationship with the pivot pin 16 shown in FIG. 5. Such mounting will produce an opposing force in the plane perpendicular to the gravity vector and thereby further enhance the ability of the anchor device 10 to resist out of plane forces which would dislodge the anchor.

In the unwedged and wedged conditions, the one or pair of compression arms 12 have a maximum length, as shown in FIGS. 2A, 2E, 10A and 10E. In the unwedged position, as shown in FIGS. 2A and 10A, the outer end 20B of the inner member 20 of the compression arm 12 contacts one of the opposing walls W of the cleft L, the inner end 14B of the load arm 14 contacts the other of the opposing walls W of the cleft L and the outer end 14A of the load arm 14 does not contact either of the walls W of the cleft L. In the wedged position, as shown in FIGS. 2E and 10E, the outer end 20B of the outer member 20 of the compression arm 12 contacts the one opposing wall W of the cleft L, the inner end 14B of the load arm 14 contacts the other opposing wall W of the cleft L and the outer end 14A of the load arm 14 contacts the same wall W of the cleft L as does the outer end 20B of the outer member 20.

The compression arm 12 changes away from its maximum length toward its minimum length and back toward its maximum length as the compression and load arms 12, 14 are moved from the unwedged condition to the wedged condition of the device 10 in the pull-down mode of placing the device 10. The compression and load arms 12, 14 also can assume an intermediate condition between the unwedged and wedged conditions of the device 10. In the intermediate condition, as shown in FIGS. 2C and 10C, the one or pair of compression arms 12 are substantially disposed along the horizontal reference H and has a minimum length and the one or pair of load arms 14 are substantially disposed below the horizontal reference H. The outer end 20B of the outer member 20 contacts the one opposing wall W of the cleft L, the inner end 14B of the load arm 14 contacts the other opposing wall W of the cleft L and the outer end 14A of the load arm 14 does not contact either of the walls W of the cleft L. Movement of the compression and load arms 12, 14 between the unwedged, intermediate and wedged conditions of the device 10 allows for the self-adjustment of the compression and load arms 12, 14 within the cleft to the wedged or secured condition of the device 10 and enables use of the compression and load arms 12, 14 in clefts of different sizes.

The compression and load arms 12, 14 define holes 32, 34 therethrough at their respective inner ends 12B, 14B for receiving the pivot element 16. The inner end 22A of the inner member 22 of each compression arm 12 has the hole 32 therein. Each compression arm 12 also has a hole 36 defined adjacent to and spaced interiorly from the inner end 20A of its outer member 20. The side members 28 of each load arm 14 adjacent to their inner ends 28A define the holes 34 thereof in alignment with one another which receive the pivot pin 16. The device 10 may further include a clip 38 for retaining the pivot element 16 in place within the holes 32, 34 and thereby securing the compression and load arms 12, 14 together.

The one or pair of follower cables 18 has opposite upper and lower ends 18A, 18B. The upper end 18A is mounted to the hole 36 in the inner end 20A of the outer member 20 of each compression arm 12 and is disposed through the longitudinal slot 26 of the inner member 22 of the respective compression arm 12 and is movable with the outer member 20 relative to the inner member 22 of the compression arm 12. The lower end 18B is mounted to the load arm 14 at the intermediate location thereon. The ends 18A, 18B of the cable 18 are mounted to the outer member 20 of the compression arm 12 and to load arm 14 by any suitable means, such as by a pin and clip. The cable 18 and pivot element 16 function to interconnect the compression and load arms 12, 14. The cable 18 may be of any suitable type.

The device 10 further includes at least one spring 40 which biases the compression arm 12 toward its maximum length. The bias of the spring 40 thereby preloads the device 10 to resist forces directed on the device 10 from outside of a plane defined by the compression and load arms 12, 14. Only one spring 40 is used in the first embodiment, and a pair of springs 40 are used in the second embodiment. The spring 40 may be of any suitable type.

Figure 4:
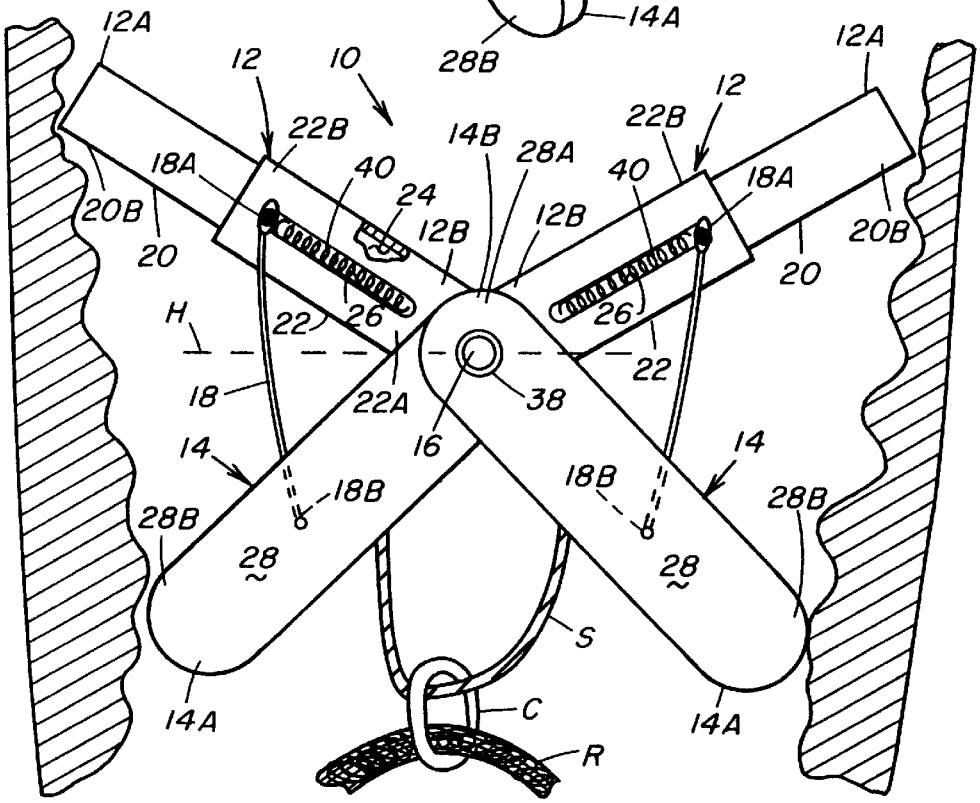
FIG. 4 is a side elevational view of the device of FIG. 3 showing the positions of the compression and load arms with the device in the wedged condition.

The device 10 is intended to be used with a sling S, a carabiner C and a climbing rope R, as shown in FIGS. 1 and 4. The sling S is coupled to the device 10 at the point of pivotal connection of the compression and load arms 12, 14 in any suitable fashion and by any suitable means. The sling S may be of any suitable type. The carabiner C is coupled to the sling S. The rope R is coupled to the carabiner C. The carabiner C and rope R may each be of any suitable type.

FIGS. 2 and 10 respectively show the pull-down mode or process of placing the first and second embodiments of the device 10 in the cleft L. More particularly, FIGS. 2A and 10A respectively depict the positions of the compression and load arms 12, 14 of the first and second embodiments of the device 10 in an initial unwedged condition of the device 10, whereas FIGS. 2B and 10B respectively depict the positions of the compression and load arms 12, 14 of the first and second embodiments of the device 10 moving toward the intermediate condition of the device 10. FIGS. 2C and 10C respectively illustrate the positions of the compression and load arms 12, 14 of the first and second embodiments of the device 10 at the intermediate condition of the device 10. FIGS. 2D and 10D respectively depict the positions of the compression and load arms 12, 14 of the first and second embodiments of the device 10 moving toward the final wedged condition of the device 10, whereas FIGS. 2E and 10E respectively illustrate the positions of the compression and load arms 12, 14 of the first and second embodiments of the device 10 upon reaching the final wedged condition of the device 10.

While not being limited to these materials, some examples of materials from which the parts of the anchor device 10 can be made are as follows. The load arm 14 and inner and outer members 22, 20 of the compression arms 12 can be made of aluminum 6061-T6 or 7075-T6. The pivot pin 16 can be made of tool steel 431 stainless steel (for corrosion resistance), the keeper cable 18 can be stainless steel cable, and the spring 40 can be made of stainless steel.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A self-adjusting rock climbing anchor device, comprising:

(a) a variable-length compression arm;

(b) a fixed-length load arm;

(c) a pivot element pivotally interconnecting said compression and load arms to one another; and (d) a fixed-length follower cable, said cable interconnecting said compression and load arms at intermediate locations thereon so as to form a four-bar linkage defined by said pivot element, said compression arm, said load arm and said follower cable, said follower cable being located at least at a side of said pivot element, said compression and load arms being movable between an unwedged condition relative to a pair of spaced apart opposing walls of a cleft, in which said compression and load arms are disposed in respective first positions relative to a horizontal reference defined by said pivot element pivotally interconnecting said compression and load arms, and a wedged condition relative to the pair of spaced apart opposing walls of the cleft, in which said compression and load arms are disposed in respective second positions relative to said horizontal reference, said movement of said compression and load arms between said unwedged and wedged conditions in response to application of a load force thereto providing for self-adjustment of said compression and load arms within the cleft and enabling use of said compression and load arms in clefts of different sizes.

2. The device of claim 1 wherein said compression and load arms in said first positions are angularly displaced from one another and disposed substantially below said horizontal reference.

3. The device of claim 1 wherein said compression arm in said second position is disposed substantially above said horizontal reference, while the load arm in said second position is angularly displaced from the compression arm and disposed substantially below said horizontal reference.

4. The device of claim 1 wherein said compression arm includes an outer member and an inner member interfitting telescopably with one another and movable relative to one another such that said compression is moved between a maximum length and a minimum length.

5. The device of claim 4 wherein:

each of said outer and inner members of said compression arm has opposite ends;

said inner member of said compression arm defines a longitudinal slot; and said follower cable has opposite upper and lower ends, said upper end being mounted to one of said opposite ends of said outer member and disposed through said longitudinal slot of said inner member and movable with said outer member relative to said inner member of said compression arm.

6. The device of claim 4 wherein said compression arm changes away from said maximum length toward said minimum length and back toward said maximum length as the compression and load arms are moved from said unwedged condition to said wedged condition.

7. The device of claim 4 wherein said compression and load arms also have an intermediate condition between said unwedged and wedged conditions in which said compression arm is substantially disposed along said horizontal reference and has said minimum length and said load arm is substantially disposed below said horizontal reference.

8. The device of claim 1 further comprising:

at least one spring biasing said compression arm toward said maximum length and thereby preloading said device to resist forces directed on said device from outside of a plane defined by said compression and load arms of said device.

9. The device of claim 1 wherein said load arm includes:

a pair of opposite side members spaced apart from one another and each having opposite ends, one of opposite ends of each of said side members having a hole receiving said pivot element; and a connecting member extending transversely between and interconnecting said side members closer to the other of said opposite ends of each of said side members so as to provide said load arm in a substantially U-shaped configuration.

10. A self-adjusting rock climbing anchor device, comprising:

(a) a variable-length compression arm;

(b) a fixed-length load arm;

(c) a pivot element pivotally interconnecting said compression and load arms to one another; and (d) a fixed-length follower cable, said follower cable interconnecting said compression and load arms at intermediate locations thereon so as to form a four-bar linkage defined by said pivot element, said compression arm, said load arm and said follower cable, said follower cable being located at a side of said pivot element, said compression and load arms being movable between an unwedged condition relative to a pair of spaced apart opposing walls of a cleft, in which said compression and load arms are angularly displaced from one another and disposed substantially below a horizontal reference defined by said pivot element pivotally interconnecting said compression and load arms, and a wedged condition relative to the pair of spaced apart opposing walls of the cleft, in which said compression arm is disposed substantially above said horizontal reference and said load arm is angularly displaced from said compression arm and disposed substantially below said horizontal reference, said movement of said compression and load arms between said unwedged and wedged conditions in response to application of a load force thereto providing for self-adjustment of said compression and load arms within the cleft and enabling use of said compression and load arms in clefts of different sizes.

11. The device of claim 10 wherein said compression arm includes an outer member and an inner member interfitting telescopably with one another and movable relative to one another such that said compression arm is movable between a maximum length and a minimum length.

12. The device of claim 11 wherein:

each of said outer and inner members of said compression arm has opposite ends;

said inner member of said compression arm defines a longitudinal slot; and said follower cable has opposite upper and lower ends, said upper end being mounted to one of said opposite ends of said outer member and disposed through said longitudinal slot of said inner member and movable with said outer member relative to said inner member of said compression arm.

13. The device of claim 11 further comprising:

a spring biasing said compression arm toward said maximum length and thereby preloading said device to resist forces directed on said device from outside of a plane defined by said compression and load arms of said device.

14. The device of claim 10 wherein said load arm includes:

a pair of opposite side members spaced apart from one another and each having opposite ends, one of opposite ends of each of said side members having a hole receiving said pivot element; and a connecting member extending transversely between and interconnecting said side members closer to the other of said opposite ends of each of said side members so as to provide said load arm in a substantially U-shaped configuration.

15. A self-adjusting rock climbing anchor device, comprising:

(a) a pair of variable-length compression arms;

(b) a pair of fixed-length load arms;

(c) a pivot element pivotally interconnecting said compression and load arms to one another; and (d) a pair of fixed-length follower cables, a first of said follower cables interconnecting a first one of said pair of said compression and a first one of said pair of load arms at intermediate locations thereon so as to form a first four-bar linkage defined by said pivot element, said first one of said of compression arms said first one of said pair of load arms and said first follower cable, said first follower cable being located at a first side of said pivot element, a second of said follower cables interconnecting a second of said pair of said compression arms and a second of said pair of said load arms at intermediate locations thereon so as to form a second four-bar linkage defined said pair of compression arms, said second of said pair of said load arms and said second follower cable, said second follower cable being located at an opposite second side of said pivot element, said pairs of compression and load arms being movable between an unwedged condition relative to a pair of spaced apart opposing walls of a cleft, in which said compression and load arms are disposed in respective first positions relative to a horizontal reference defined by said pivot element pivotally interconnecting said pairs of compression and load arms, and a wedged condition relative to the pair of spaced apart opposing walls of the cleft, in which said compression and load arms are disposed in respective second positions relative to said horizontal reference, said movement of said pairs of compression and load arms between said unwedged and wedged conditions in response to application of a load force thereto providing for self-adjustment of said compression and load arms within the cleft and enabling use of said compression and load arms in clefts of different sizes.

16. The device of claim 15 wherein said compression and load arms in said first positions are angularly displaced from one another and disposed substantially below said horizontal reference.

17. The device of claim 16 wherein said compression arms in said second position is disposed substantially above said horizontal reference, while the load arms in said second position is angularly displaced from said compression arms and disposed substantially below said horizontal reference.

18. The device of claim 15 wherein each of said compression arms includes an outer member and an inner member interfitting telescopably with one another and movable relative to one another such that said compression arm is movable between a maximum length and a minimum length.

19. The device of claim 18 wherein:

each of said outer and inner members of each of said compression arms has opposite ends;

said inner member of said each compression arm defines a longitudinal slot; and each of said follower cables has opposite upper and lower ends, said upper end being mounted to one of said opposite ends of said outer member of one of said compression arms and disposed through said longitudinal slot of said inner member of said one compression arm and movable with said outer member of said one compression arm relative to said inner member of said one compression arm.

20. The device of claim 18 wherein said compression arms change away from said maximum length toward said minimum length and back toward said maximum length as the compression and load arms are moved from said unwedged condition to said wedged condition.

21. The device of claim 18 wherein said compression and load arms also have an intermediate condition between said unwedged and wedged conditions in which said compression arms are substantially disposed along said horizontal reference and has a minimum length and said load arms are substantially disposed below said horizontal reference.

22. The device of claim 15 further comprising:

a pair of springs biasing said compression arms toward a maximum length and thereby preloading said device to resist forces directed on said device from outside of a plane defined by said compression and load arms of said device.

23. The device of claim 15 wherein each of said load arms includes:

a pair of opposite side members spaced apart from one another and each having opposite ends, one of opposite ends of each of said side members having a hole receiving said pivot element; and a connecting member extending transversely between and interconnecting said side members closer to the other of said opposite ends of each of said side members so as to provide said load arm in a substantially U-shaped configuration.

* * * * *